US006682024B2

(12) United States Patent
Steinmann et al.

(10) Patent No.: US 6,682,024 B2
(45) Date of Patent: Jan. 27, 2004

(54) DEVICE FOR SETTING SYMMETRY IN A RAILWAY SWITCH SYSTEM

(75) Inventors: Markus Steinmann, Zürich (CH); Otto Egli, Winterthur (CH)

(73) Assignee: Siemens Switzerland Ltd., Zürich (CH)

( * ) Notice: Subject to any disclaimer, the term of this patent is extended or adjusted under 35 U.S.C. 154(b) by 70 days.

(21) Appl. No.: 09/972,326

(22) Filed: Oct. 5, 2001

(65) Prior Publication Data

US 2002/0040952 A1 Apr. 11, 2002

(30) Foreign Application Priority Data

Oct. 5, 2000 (EP) ..... 00121748

(51) Int. Cl.[7] ..... B61L 5/00
(52) U.S. Cl. ..... 246/450; 246/452
(58) Field of Search ..... 246/449, 450, 246/451, 452

(56) References Cited

U.S. PATENT DOCUMENTS

| | | | | | |
|---|---|---|---|---|---|
| 689,374 | A | * | 12/1901 | Warren | 246/450 |
| 822,413 | A | * | 6/1906 | Weston | 246/451 |
| 824,354 | A | * | 6/1906 | Green | 246/450 |
| 1,118,915 | A | * | 12/1914 | Broluska | 188/196 M |
| 1,159,319 | A | * | 11/1915 | Larry | 246/437 |
| 1,270,824 | A | * | 7/1918 | Holdeman | 246/452 |
| 1,359,269 | A | * | 11/1920 | Notraeschi | 246/450 |
| 1,426,097 | A | * | 8/1922 | Post | 246/158 |
| 1,463,984 | A | * | 8/1923 | Walker | 246/450 |
| 2,077,620 | A | * | 4/1937 | Dicke | 174/138 D |
| 2,316,312 | A | * | 4/1943 | Bone | 246/450 |
| 2,377,818 | A | * | 6/1945 | Smith | 246/450 |
| 5,620,156 | A | | 4/1997 | Berggren et al. | |

FOREIGN PATENT DOCUMENTS

| | | |
|---|---|---|
| WO | WO 94/27853 | 12/1994 |

* cited by examiner

*Primary Examiner*—Mark T. Le
(74) *Attorney, Agent, or Firm*—Laurence A. Greenberg; Werner H. Stemer; Ralph E. Locher

(57) ABSTRACT

Railway switches are subjected to a high degree of stress due to the influences of weather and as a result of trains traveling over them. This may result in changes in adjustments and settings made at the time of mounting. In order to permit, in particular in the case of hollow sleepers, simple re-adjustment of a drive rod relative to the cam rods, an attachment element can be connected to an attachment flange by a positive lock, formed by various adjustment keys and a main key, and using locking screws in such a way that fine adjustment by appropriately selecting the arrangement of the adjustment keys is possible. Coarse adjustment is made by an asymmetric arrangement of the bore holes for connecting to a drive rod as well as by selecting one of the two bore holes.

13 Claims, 4 Drawing Sheets

DEVICE FOR SETTING SYMMETRY IN A RAILWAY SWITCH SYSTEM

BACKGROUND OF THE INVENTION

Field of the Invention

The present invention lies in the railway technology filed. More specifically, the invention relates to a device for setting symmetry in a railway switch system which is installed in particular in a rail sleeper and which has a drive rod and in each case a cam rod connected to a switch blade. The cam rod and the drive rod can be fixedly connected to one another with locking means.

Railway switches are subjected to severe stresses due to influences of the weather and as a result of trains traveling over them. This can result in changes in the adjustments and settings made at the time of mounting. In particular, uniform coverage of closure catches which are assigned to the switch blades are to be ensured by means of an adjustment. In the text which follows, the term adjustment as used here is understood to also refer to the setting of symmetry in a railway switch system.

U.S. Pat. No. 5,620,156 (international PCT publication WO 94/27853) describes a modular railway switch system which is integrated into a hollow sleeper and which is composed of individual modules, which can to a certain extent be optionally replaced.

A railway switch system typically has at least one drive rod which transmits the longitudinal movement generated by a railway switch drive to the switch blades. Switch blades are themselves generally connected to one cam rod each in this context. Because most railway administrations demand a further electrical insulation means between the left-hand and right-hand switch blades as well as further insulation from the drive rod, an attachment part which is arranged in an insulated fashion and which permits force to be transmitted from the drive rod to the cam rod is provided. The spatial conditions are very limited in a hollow sleeper. As a result, the accessibility of the components is made much more difficult. Necessary re-adjustments are consequently associated with the removal of individual components or modules and with tedious manual work. However, the initial mounting and adjustment can also be considerably adversely affected by the tight spatial conditions. In such a context, it should be possible to make the settings to a resolution of approximately 1 mm.

It is also desirable to be able to use parts of railways switch systems repeatedly, and function components should thus be independent of the respective design and dimensions. In particular it is desirable for parts to be capable of being used independently of the track gauge.

SUMMARY OF THE INVENTION

It is accordingly an object of the invention to provide a device for setting the symmetry in a rail point switch, which overcomes the above-mentioned disadvantages of the heretofore-known devices and methods of this general type and which permits adjustment and setting of symmetry in the railway switch system to be carried out flexibly and easily and with the required resolution.

With the foregoing and other objects in view there is provided, in accordance with the invention, a device for setting symmetry in a railway switch system, comprising:

a drive rod;

a cam rod connected to a switch blade of a railway switch system; and a locking device releasably locking said cam rod and said drive rod to one another;

wherein, with said locking means released, said cam rod and said drive rod are displaceable relative to one another in grid steps, and said locking device is configured to lock said cam rod and said drive rod with a positive lock.

In other words, by virtue of the fact that the cam rod and the drive rod can be displaced relative to one another in a grid when the locking device is released and can be fixedly connected to one another using the locking means by means of a positive lock, the setting of symmetry in a railway switch system can easily be performed with the grid corresponding to the required resolution.

In this way, the following advantages can be additionally be obtained:

i) With an attachment flange embodied as a center attachment or as a side attachment it is possible for the device according to the invention to be applied for standard gauge, wide gauge and even narrow gauge railway switch systems.

ii) Coarse adjustment can be achieved with two bore holes and/or by means of an asymmetrical arrangement of the bore holes in the attachment element, and permits flexible adaptation to the respective gauge.

iii) A taper in the bearing bolt prevents rotary application of force to parts of a railway switch system, said rotary application of force being brought about by a change in length of the switch blades owing to temperature fluctuations over the years.

iv) The positive lock formed by means of key tracks and associated adjustment keys and a main key ensures frictional coupling between the drive rod and cam rod even when the locking screws are partially released.

v) The protection plate forms a double protection function: it prevents the locking screws being released and prevents lateral displacement of the adjustment keys and of the main key.

Other features which are considered as characteristic for the invention are set forth in the appended claims.

Although the invention is illustrated and described herein as embodied in a device for setting symmetry in a railway switch system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
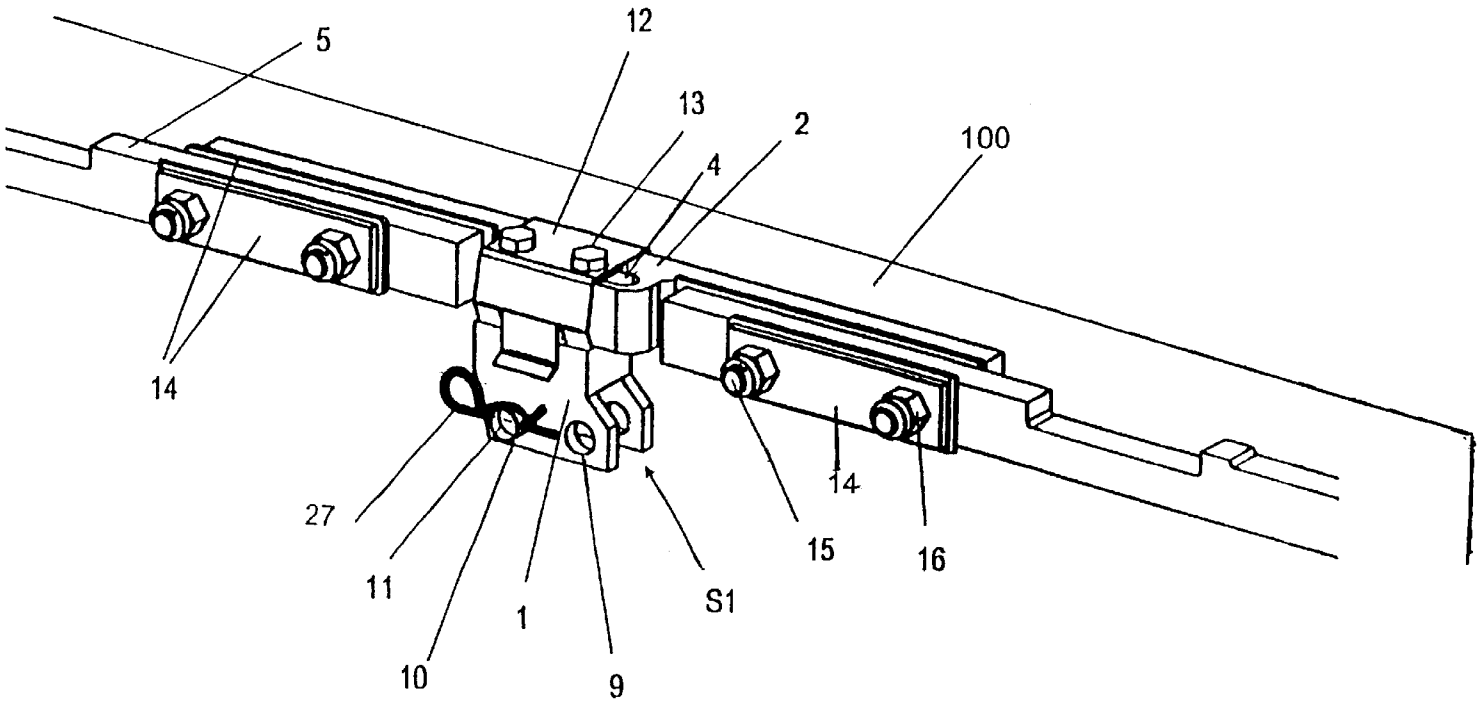
FIG. 1 is a perspective view of the device according to the invention for setting symmetry in a railway switch system in the mounted state.

Referring now to the figures of the drawing in detail and first, particularly, to FIG. 1 thereof, there is shown a device according to the invention for setting symmetry in a railway switch system in the mounted and operational state, installed in a hollow rail sleeper 100. The embodiment is preferably provided for the standard gauge, i.e., for the standard gauge of 1435 mm. Cam rods 5 which are each connected to a switch blade 22 (see FIG. 3) are coupled to what is referred to as an attachment flange 2 by means of screwed connections—each formed from a connection screw 15 and connection nut 16—via insulating plates 14. The attachment flange 2 is referred to below in this embodiment as a center attachment 2. The center attachment 2 is of the symmetrical design with respect to the axis of the track and has a significantly greater cross section in the center part. A penetrating locking slit 4 is milled into the center part and has two plan-parallel faces. An attachment element 1 with the center attachment 2 is connected to locking screws 13, the attachment element 1 being displaceable relative to the center attachment 2 in the released state. Details of this are found in FIG. 2.

A bearing bolt 11 is guided through a bore hole 9 or 10 and is guided in the slit S1 by means of a drive rod 20 (see FIG. 4) and thus permits force to be transmitted from the drive rod 20, via the attachment element 1, the center attachment 2, and the cam rods 5, to the switch blades 22. In order to prevent the locking screws 13 being released as a result of vibration, the protection plate 12 is provided which in this embodiment has openings which are fitted over the hexagonal heads of the locking screws 13 and over the center part of the center attachment on each side. In order to be able to bring about a connection which is defined by means of a torque key, for example, such an opening is formed by punching a hexagon twice in such a way that before the second punching operation a rotation of the tool through 30° relative to the protection plate is performed. As a result, the tightening of the screws can be performed with a resolution of approximately 30° and the locking screws 13 can be reliably protected against spontaneous release. As a result of the fact that the locking screws 13 are easily accessible from above, adjustment can easily be performed at the time of the first mounting or when maintenance is performed on the railway switch.

Figure 2:
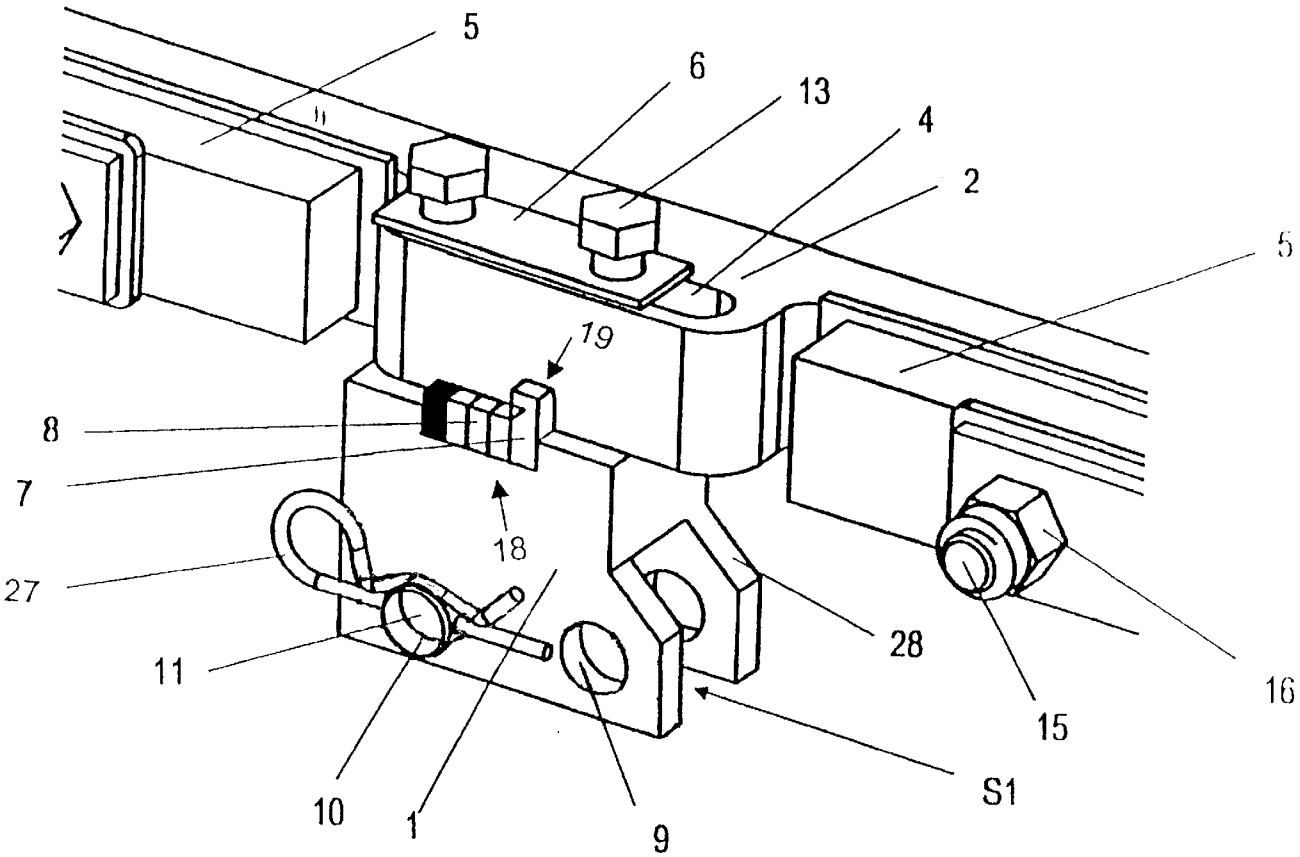
FIG. 2 is an enlarged perspective detail of the device according to the invention in the released state.

FIG. 2 shows a detailed view of the device according to the invention in a released and partially disassembled state. In order to ensure a stable connection between the center attachment 2 and the attachment element 1, a clamping plate 6 is provided. The locking slit 4 is dimensioned, for example, in such a way that in each case a displacement of, for example, 16 mm can be achieved as a desired relative position from a symmetrical center position. The bore holes 9 and 10 through which in each case a securing bolt 11 is plugged in order to connect to the drive rod 20, are arranged asymmetrically. As a result, a relatively large grid-like displacement, as a first, so-called coarse setting of for example 32 mm, can be achieved only by arranging the attachment element 1 offset through 180°.

A positive lock (i.e., a form lock) is provided between the center attachment 2 and attachment element 1 in accordance with the illustration in FIG. 1 as follows: the center attachment 2 has, transversely with respect to its direction of movement in the railway switch system, a continuous key track 19, for example with a width of 8 mm, in the lower part of the center attachment 2. The attachment element 1 itself also has, on its upper part between the threads provided for the locking screws, a key track 18. The latter is, however, considerably wider than the key track 19 of the center attachment 2. By way of example, the key track may have a width of 32 mm. These two key tracks permit a grid-like displaceability by means of the connections (shown in FIG. 1) of attachment element 1 and relative to the cam rod 5, by means of a key part 7 and a plurality of adjustment keys 8 (also referred to as intermediate bearings). In other words, the displacement is in discrete steps, i.e., the adjustability is discrete instead of infinite. The adjustment keys 8 are configured in various widths. In the dimensioning example here having the width 8 mm for the center attachment 2 and 32 mm for the attachment element 1, the remaining 32 mm−8 mm=24 mm are configured as follows:

Three (3) attachment keys with a width of 8 mm each.

Figure 5:
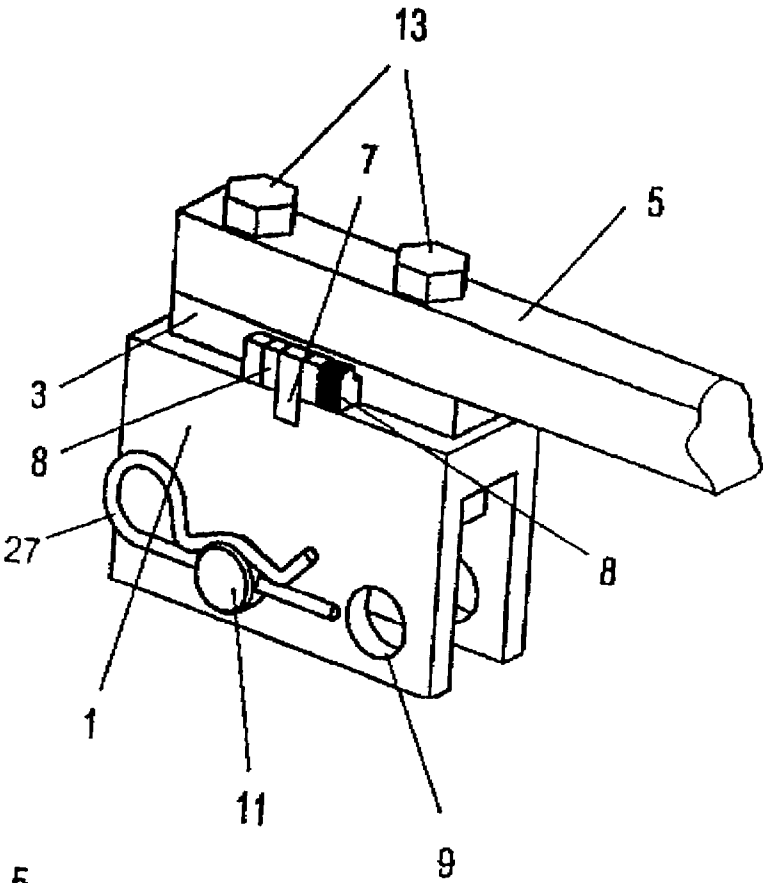
FIG. 5 is a perspective detail view of the device according to the invention in the embodiment for relatively small gauges with the protection plate removed.

Eight (8) attachment keys with a width of 1 mm each (illustrated "filled-in" in FIGS. 2 and 5).

As a result of this dimensioning of the adjustment keys 8 which is given by way of example it is possible to set symmetry in a railway switch system in a range of 32 mm with a resolution of 1 mm, i.e., in finite steps of 1 mm. Together with the asymmetrical arrangement of the bore holes 9 and 10 relative to the center of the key track 18, this thus results in additional stepped displaceability in a range of 64 mm relatively between the drive rod and switch blade. Further displaceability is obtained by the use of bore hole 9 or bore hole 10 for receiving the bearing bolt 11. In this way, it is possible to provide just one bore hole for receiving the bearing bolt 11 in the drive rod 20, and this also has advantageous effects for the maintenance of the bearings.

Figure 3:
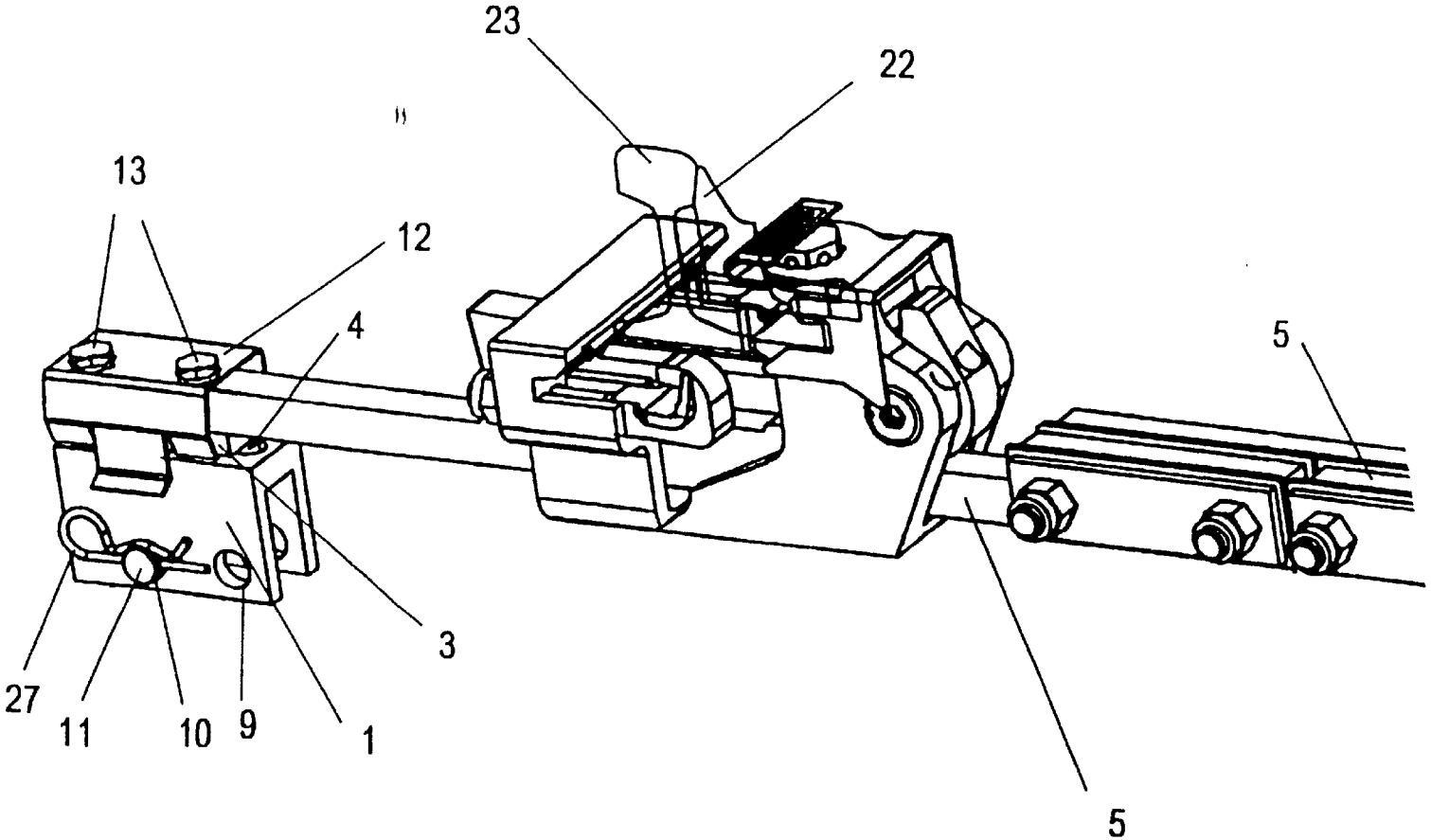
FIG. 3 is a perspective view of the device according to the invention for setting symmetry in an embodiment for relatively small gauges.

FIG. 3 shows a view of the device according to the invention for setting symmetry in an embodiment for relatively small gauges, for example 1000 mm. With relatively small gauges, the center attachment 2 can, in particular, no longer be placed using standardized components. The attachment flange 2 for the connection between the drive rod 20 and cam rod 5 is instead arranged outside the region defined by the two rails 23 and switch blades 22. In this advantageous embodiment, a side attachment 3 is provided as attachment flange. In this embodiment, the attachment element 1 is modified with respect to the asymmetric arrangement of the bore holes 9 and 10 for receiving a bearing bolt 11 in comparison with the attachment element 1 in accordance with the embodiments shown in FIG. 1 in two ways: the bore holes 9 and 10 are still arranged asymmetrically but the attachment element 1 according to FIG. 3 has, in contrast with the illustration in FIGS. 1 and 2, no oblique rib 28. The second modification relates to the width of the key tracks 18 in the attachment element 1 and a key track 19 in the side attachment or center attachment 2. This embodiment of the key tracks can be seen in the illustration in FIG. 5. The key track of the side attachment has, according to the abovementioned dimensioning example, a width of 32 mm, while the key track in the attachment element 1 is provided merely for receiving the main key 7 with a width of 8 mm. Consequently, in the embodiment according to FIG. 3, the locking slot 4 is milled into the attachment element 1. However, preferably just one embodiment of the attachment element for various gauges is used, and correspondingly it only needs in each case just one corresponding embodiment of the center attachment 2 or of the side attachment 3, which are referred to in this document by the term attachment flange. The insulated connection between the two cam rods 5 is illustrated on the right in FIG. 3 and embodied in a comparable way as can be inferred in particularly from the description in FIG. 1.

The protection plate 12 has, in addition to the already mentioned protection function for the locking screws 13, a further function: the main key 7 and adjustment keys 8 are thus protected against lateral displacement. The protection plate 12 is preferably of identical design for the side attachment 3 and center attachment 2. The protection plate is U-shaped in cross section with an indent toward the end of the U. It is fitted over the attachment flange 2, 3 and protected against inadvertent release with frictional locking thanks to the indent.

Figure 4:
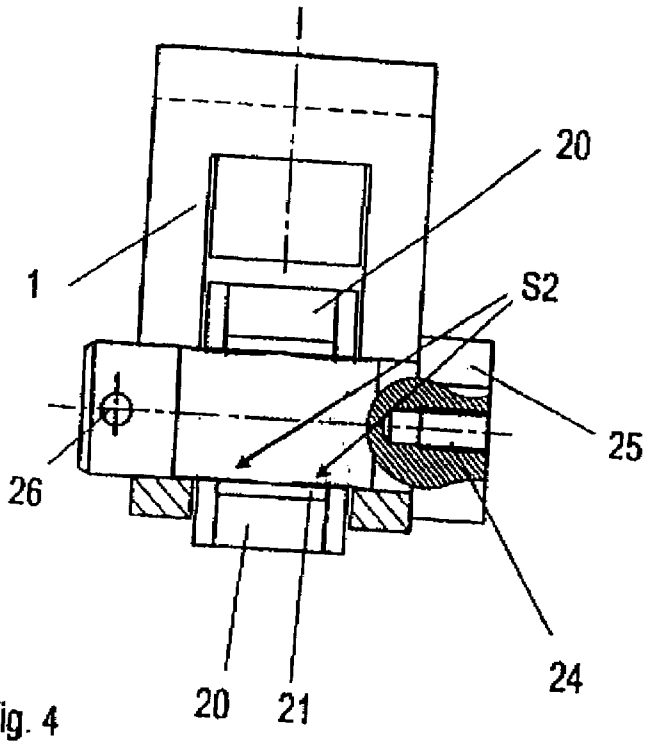
FIG. 4 is a sectional view through an attachment element with bearing bolts and a drive rod being illustrated.

Railway switches, in particular the switch blades, are subjected to considerable changes in length due to seasonal temperature fluctuations. The structure of railway switch systems must therefore take into account a change in length of the order or magnitude of 150 mm to 200 mm depending on the radius of the deflecting direction of the railway switches. With a rigid design—in particular with a design with a center attachment—such a change in length can exert a considerable application of force to the center attachment 2, and thus also to the drive rod 20. In both designs with a center attachment 2 or side attachment 3, there is therefore provision, in a further particularly advantageous embodiment of the invention, to make the bearing bold 11 tapered. FIG. 4 illustrates a double taper, i.e. arranged in pairs, of the bolt diameter with the reference symbol S2 in a sectional view through an attachment element. The taper relates in this embodiment to that region of the bearing bolt 11 which engages in the drive rod 20. As a result, a small degree of rotatability of the drive rod 20 relative to the attachment element 1 transversely to its direction of activation is ensured. This taper can be embodied in a precisely circular shape or only in a substantially circular shape, for example with a radius of 75 mm. Where the two tapers meet a preferably convex shape (in section) is selected which is formed, for example, with a radius of 25 mm. This position is in each case the main attachment point of the application of force between the bearing bolt 11 and drive rod 20.

FIG. 4 also shows a threaded bolt 24 for the disassembly—also referred to as removal—of the bearing bolt 11. As a result of the mechanical stress and as a result of contamination effects, the bearing bolt 11 may be capable of being pulled off only under the effect of the force. In such a case, the bearing bolt 11 can be removed by means of a screw which is to be screwed into the threaded hole 24. FIG. 4 also shows the head 25 and a hole 26 in the bearing bolt. The head 25 can be cylindrical or in the form of a hexagon. The hole 26 is used to receive a detent spring 27 or a cotter pin 27. When dimensioning the width of the attachment element 1 and the length of the bearing bolts 11, the restricted width of the hollow sleeper is to be taken into account in such a way that removal by hand is easily possible, in particular it is necessary for sufficient clearance to be present on both sides for the bearing bolt 11 and the main key and the adjustment keys 8 to be capable of being inserted and extracted easily. The bolt 11 projects through a bore 21 formed in the rod 20.

The positive lock described for the side attachment 3 and center attachment 2 by means of the key tracks has the advantage that in the event of the protection plate being lost and the locking screws 13 having already been released, force can still be transmitted between the drive rod 20 and cam rods 5.

The positive lock described above between the attachment element 1 and attachment flange 2 or 3 is not restricted to this embodiment with the aforementioned key track, main key 7 and adjustment keys 8. Other positive locks which are embodied in a rib-like fashion are also conceivable. Such a positive lock can be embodied, for example, as also referred to as an indented connection, for example the areas of the attachment element 1 and attachment flange 2 or 3 which bear one against the other have a saw-tooth shape in cross section, two successive peaks of the saw tooth being spaced apart by the distance required for the resolution, this distance being typically 1 mm.

The structural implementation is also possible in such a way that certain of the abovementioned parts are embodied as a single component; in this way the attachment element 1 and drive rod 22, for example, can thus be provided as a single component.

We claim:

1. A device for setting symmetry in a railway switch system, comprising:

a drive rod;

a cam rod connected to a switch blade of the railway switch system;

a locking device releasably locking said cam rod and said drive rod to one another, with said locking device released, said cam rod and said drive rod being displaceable relative to one another in discrete grid steps, and said locking device being configured to lock said cam rod and said drive rod with a positive lock;

an attachment flange formed as a side attachment and an attachment element connected to said drive rod, said cam rod being fixedly coupled to said attachment flange, said attachment flange and said attachment element being displaceable relative to one another in a first grid and being fixable to one another by said locking device with said positive lock; and a bearing bolt connecting said drive rod to said attachment element, a second grid being defined by at least two bore holes formed in said attachment element through which said bearing bolt is selectively insertible.

2. The device according to claim 1, wherein said cam rod is one of two cam rods each connected to a switch blade.

3. The device according to claim 1, wherein said bearing bolt is secured with a detent spring.

4. The device according to claim 1 wherein, in a vicinity of a cylindrical bushing through said drive rod, said bearing bolt is formed with a taper opposite said bushing, and said taper is substantially circular to permit said drive rod to rotate to a small extent transversely with respect to an actuation direction thereof.

5. The device according to claim 4, wherein said taper is one of two tapers respectively formed in the vicinity of said bushing through said drive rod.

6. The device according to claim 1, wherein said locking device includes locking screws configured to be screwed into said attachment element.

7. The device according to claim 1, wherein said bore holes are formed asymmetrically in said attachment element, defining a third grid, and said attachment element is fixedly connectible to said attachment flange in two positions rotated through 180° relative to one another.

8. The device according to claim 1, wherein said attachment element and said attachment flange are each formed with a key track, and wherein said positive lock is effected by a plurality of adjustment keys engaging in one of said key tracks and by a main key engaging in both key tracks, and wherein said first grid is formed by a width of said adjustment keys.

9. The device according to claim 8, wherein the width of said adjustment keys and a width of said main key is equal to a width of one key track, and the width of the main key is equal to a width of the other key track.

10. The device according to claim 6, wherein said locking screws are formed with a hexagonal screw head, and a protection plate is formed with a hexagonal or dodecagonal opening corresponding to a size of said hexagonal screw head.

11. The device according to claim 10, wherein said protection plate is formed to prevent said locking screws from being released, and said protection plate is pressed over said attachment flange and protects against inadvertent release by frictional locking.

12. The device according to claim 10, wherein said protection plate is formed to protect said adjustment keys and said main key against lateral displacement.

13. A combination with a hollow rail sleeper of a railroad switch assembly, including the device according to claim 1 installed in the hollow rail sleeper.

* * * * *